US008822806B2

(12) United States Patent
Cockerell et al.

(10) Patent No.: US 8,822,806 B2
(45) Date of Patent: Sep. 2, 2014

(54) CONFIGURABLE FOOT-OPERABLE ELECTRONIC CONTROL INTERFACE APPARATUS AND METHOD

(75) Inventors: David Cockerell, London (GB); Michael Matthews, Northport, NY (US)

(73) Assignee: New Sensor Corp., Long Island City, NY (US)

( * ) Notice: Subject to any disclaimer, the term of this patent is extended or adjusted under 35 U.S.C. 154(b) by 0 days.

(21) Appl. No.: 13/101,031

(22) Filed: May 4, 2011

(65) Prior Publication Data

US 2011/0271820 A1 Nov. 10, 2011

Related U.S. Application Data

(60) Provisional application No. 61/331,108, filed on May 4, 2010.

(51) Int. Cl.

| | |
|---|---|
| ***G10H 1/32*** | (2006.01) |
| ***G10H 3/00*** | (2006.01) |
| ***G10H 1/34*** | (2006.01) |

(52) U.S. Cl.

CPC ..... *G10H 1/348* (2013.01); *G10H 2220/395* (2013.01)

USPC ..... 84/746

(58) Field of Classification Search

USPC ..... 84/746, 721

See application file for complete search history.

(56) References Cited

U.S. PATENT DOCUMENTS

| | | | | |
|---|---|---|---|---|
| 7,923,623 | B1 * | 4/2011 | Beaty | 84/701 |
| 2004/0099129 | A1 * | 5/2004 | Ludwig | 84/663 |

* cited by examiner

*Primary Examiner* — Jeffrey Donels

(74) *Attorney, Agent, or Firm* — Cozen O'Connor

(57) ABSTRACT

The present inventive foot-operable apparatus and method comprise a generally rectangular housing comprising at least one internally positioned accelerometer sensor component, and also including at least one pedal-type component oriented toward, and operable by, a user, and advantageously enable the operating user to produce one or more control signals, of one or more types, and within one or more ranges, in response to the user's predetermined interaction(s) therewith. The novel utilization by the present invention of at least one accelerometer sensor component provides it with numerous advantageous features (such as extensive flexibility, ease of adaptation/configuration, etc.), and a wide range of functionality, while facilitating its easier transport and operation, and greatly increasing the reliability thereof. The apparatus and method of the present invention can be used to provide a configurable, flexible and reliable foot-operable control interface to virtually any electronic and/or electromechanical system.

4 Claims, 3 Drawing Sheets

CONFIGURABLE FOOT-OPERABLE ELECTRONIC CONTROL INTERFACE APPARATUS AND METHOD

CROSS REFERENCE TO RELATED APPLICATIONS

The present patent application claims priority from the commonly assigned U.S. provisional patent application 61/331,108 entitled "Configurable Foot-Operable Electronic Control Interface Apparatus and Method", filed May 4, 2010.

FIELD OF THE INVENTION

The present invention relates generally to foot-operable electronic control interface devices and methods capable of producing control signals of one or more types and within one or more ranges, in response to predetermined interaction(s) therewith by a user, and more particularly to a pedal-type electronic control device and method that comprises at least one accelerometer operable to sense at least one predetermined tilting angle of the pedal during user operation thereof, and, in response to one or more parameters output by the at least one accelerometer, generating at least one corresponding control signal as the device output, operable to control, in a predetermined manner, one or more predefined external devices and/or systems (for example, when associated with a musical instrument being played by a musician user, enabling the musician user to control one or more attributes of the sound being generated during operation of the musical instrument).

BACKGROUND

For decades foot-operated electromechanical control interface devices have been in widespread use in a variety of applications, to provide users with hands-free control capabilities in connection with their operation of one or more electromechanical/electronic systems and/or devices that occupy both of their hands during use. Such electronic systems/devices range from industrial equipment (fabrication machine/work station, etc.), for which such control devices may be used for motor speed control, start/stop, etc.), to musical instruments by musician users, in connection with which, the foot-operated control devices may be used to apply predetermined user-controlled modifications to various attributes of the sound output of the musical instrument(s) being played (e.g., such as application of "effects"—wah-wah, etc, volume control, pitch, etc.).

Because musicians typically use both of their hands to play their instrument, they very frequently rely on various foot-operated control interface devices to provide additional control over the sound being produced during their performance. For example, a typical organ's manual keyboard provides no volume control, while an electric guitar, provides very limited manual control over its timbre.

As a result, most musicians utilize pedals as foot-operated control/adjustment interfaces or their instruments. All such previously known pedals invariably comprise a spring-retained tilting treadle joined to a heavy static base at one end by a hinge (or equivalent) with corresponding further linkage to an electromechanical component (most commonly, a potentiometer), for determining the tilting angle of the treadle with respect to the base. The most common implementation of such pedals includes a rotary potentiometer with the linkage being a rack and pinion gear (or equivalent) so that a typical 15 degree angular range of treadle tilt is capable of turning the potentiometer through its full 270 degrees of rotation.

The disadvantages of such conventional "rack & pinion" potentiometer-based pedal solutions are many, and they include, but are not limited to, the following flaws:

1) The mechanical construction thereof results in such pedal devices being complicated, heavy, and expensive;
2) Friction and hysteresis in the linkage to the potentiometer, as well as the necessary maximum angular motion range of the treadle with respect to the pedal base, not only limits the speed, accuracy, and precision with which the musician can control the desired sound parameters, but also limits the maximum range of such control;
3) Potentiometers are subject to wear, and need to be replaced after extensive use;
4) The mechanical linkages are also prone to damage or breakage after extensive and/or rough use, reducing the reliability of such pedal solutions; and
5) The control element for activation/deactivation of previously known pedals are either difficult to access by the user during pedal operation, or, most commonly, are implemented as pop-up switches in the base of the pedal, positioned under the treadle, and are operable by the user fully pressing down on the treadle to a sufficient angular range to activate (or deactivate) the switch—an arrangement which, in the heat of a musician's performance may result in inadvertent (and highly undesirable) activation and/or deactivation of the control pedal.

Thus, it would be desirable to provide an foot-operable control interface apparatus and method that addresses all of the drawbacks of the previously known foot-operable control solutions, and that includes numerous advantageous features (such as extensive flexibility, ease of adaptation/configuration, etc.), and a wide range of functionality, while being easy to transport and operate, and having superior reliability.

BRIEF DESCRIPTION OF THE DRAWINGS

In the drawings, wherein like reference characters denote corresponding or similar elements throughout the various figures.

SUMMARY OF THE INVENTION

Figure 1:
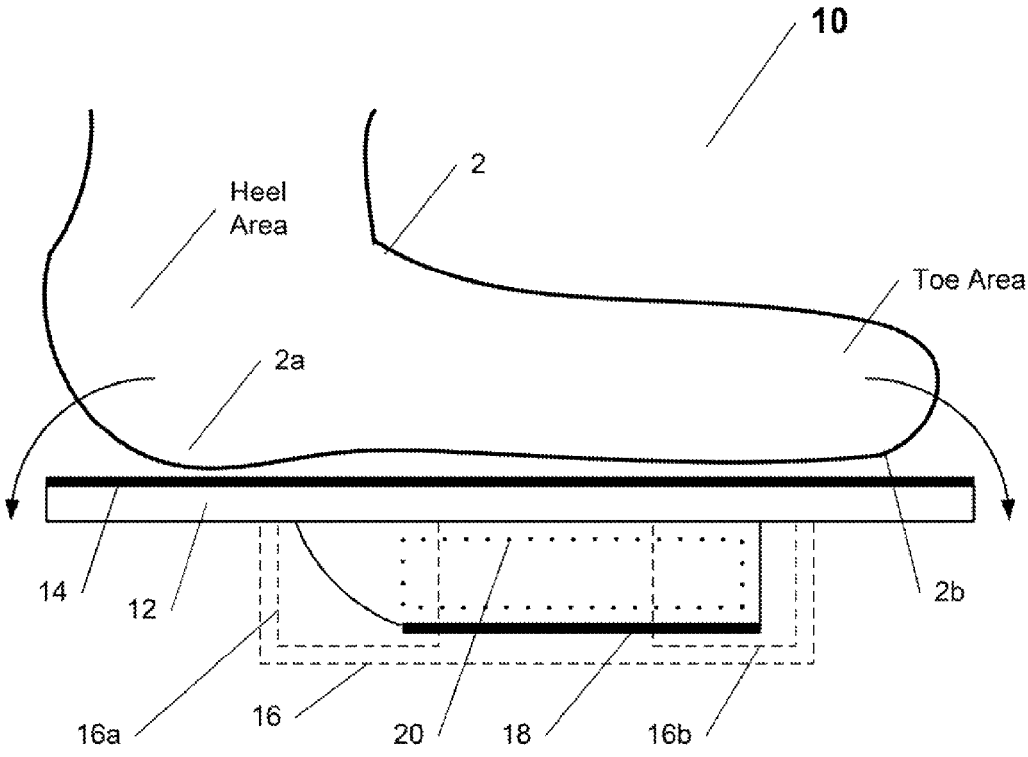
FIG. 1 is a schematic diagram of an exemplary first embodiment of a configurable foot-operable electronic control interface apparatus of the present invention.

The present inventive foot-operable apparatus and method comprise a generally rectangular housing comprising at least one internally positioned accelerometer sensor component, and also including at least one pedal-type component oriented toward, and operable by, a user, and advantageously enable the operating user to produce one or more control signals, of one or more types, and within one or more ranges, in response to the user's predetermined interaction(s) therewith.

The novel utilization by the present invention of at least one accelerometer sensor component provides the inventive apparatus and method with numerous advantageous features (such as extensive flexibility, ease of adaptation/configuration, etc.), and a wide range of functionality, while facilitating its easier transport and operation, and greatly increasing the reliability thereof. The at least one accelerometer component of the inventive apparatus, is operable to:

(1) sense at least one predetermined tilting angle of the pedal component during the user's control interaction therewith and provide the resulting output to a data processing component of the apparatus, and, (2) in response to one or more parameters output by the at least one accelerometer, generating at least one corresponding control signal as the inventive device output, the control signal being operable to control, in a predetermined manner, one or more predefined external devices and/or systems.

In one exemplary embodiment thereof, the inventive apparatus is associated with a musical instrument being played by a musician user, and advantageously enables the musician to operate it to control one or more attributes of the sound being generated during operation of the musical instrument in accordance with the output of its at least one accelerometer sensor components. In alternate embodiments of the invention, plural inventive devices may be readily used to provide a greater range of control capabilities to a single external system, or to provide simultaneous control capabilities to plural external systems. Advantageously, the apparatus and method of the present invention can be used to provide a configurable, flexible and reliable foot-operable control interface to virtually any electronic and/or electromechanical system.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

DETAILED DESCRIPTION

The present invention advantageously overcomes the drawbacks and disadvantages of previously known foot-operable control interface and control device solutions, and further includes numerous advantageous features, such as extensive flexibility, ease of adaptation/configuration, etc., as well as a wide range of functionality, while being easy to transport and operate, and having superior reliability.

Referring now to FIG. 1, an exemplary first embodiment of the inventive foot-operable electronic control interface (ECI) apparatus is shown as ECI unit 10 that is operable by specific motions of a user's foot 2 positioned thereon. The ECI unit 10 includes a pedal platform 12 (optionally comprising a non-slip layer 14 positioned thereon), and also includes a generally rectangular-shaped housing 16, provided for storing at least one accelerometer sensor and other electronic components, shown as control component 20, the housing 16 being positioned under, and attached to, a generally central potion of the pedal platform 12, and having a rear portion 16*a* oriented toward a rear end of the pedal platform 12, and a front portion 16*b* oriented toward a front portion of the pedal platform 12. Alternately, the housing 16 and the pedal platform 12 may be integrally formed as a single integrated component, such that, for example, the top surface of the housing 16 functions as the pedal 12. The housing 16 optionally comprises a non-slip layer 18 (or equivalent, such as rubberized feet, etc,) on the bottom surface thereof.

Preferably, the housing 16 is sized and configured such that a front section of the pedal platform 12 extends a first predetermined distance from its front portion 16*b*, while a rear section of the pedal platform 12 extends a second predetermined distance from its rear portion 16*a*. This arrangement enables the user to (1) selectively tilt the ECI unit 10 backward, through a predefined rear tilting range, by pressing their foot heel area 2*a* on the rear section of the pedal platform 12, and thereby rear-tilting the housing 16 and the control component 20 disposed therein to activate at least one first predetermined function in response to change in relative position (from previous position, such as "resting") of the control component 20, and (2) to selectively tilt the ECI unit 10 forward, through a predefined forward tilting range, by pressing their foot toe area 2*b* on the front section of the pedal platform 12, and thereby front-tilting the housing 16 and the control component 20 disposed therein to activate at least one second predetermined function (which may include, but is not limited to, toggling the at least one first predetermined function ON/OFF) in response to change in relative position (from previous position, such as "resting") of the control component 20.

Optionally, as described in greater detail below in connection with FIG. 3, the housing 16 may be readily configured to support lateral tilting/rocking motion (or alternately to support free-form 3-dimensional motion, such as for example by providing a hemispherical bottom section therefor), that would advantageously enable, along with an appropriately configured control component 20, the ECI unit to be utilized for many different control functions, all controlled by the user's positioning and motion (tilting, rocking, spinning, etc.) of the pedal platform 12.

Figure 3:
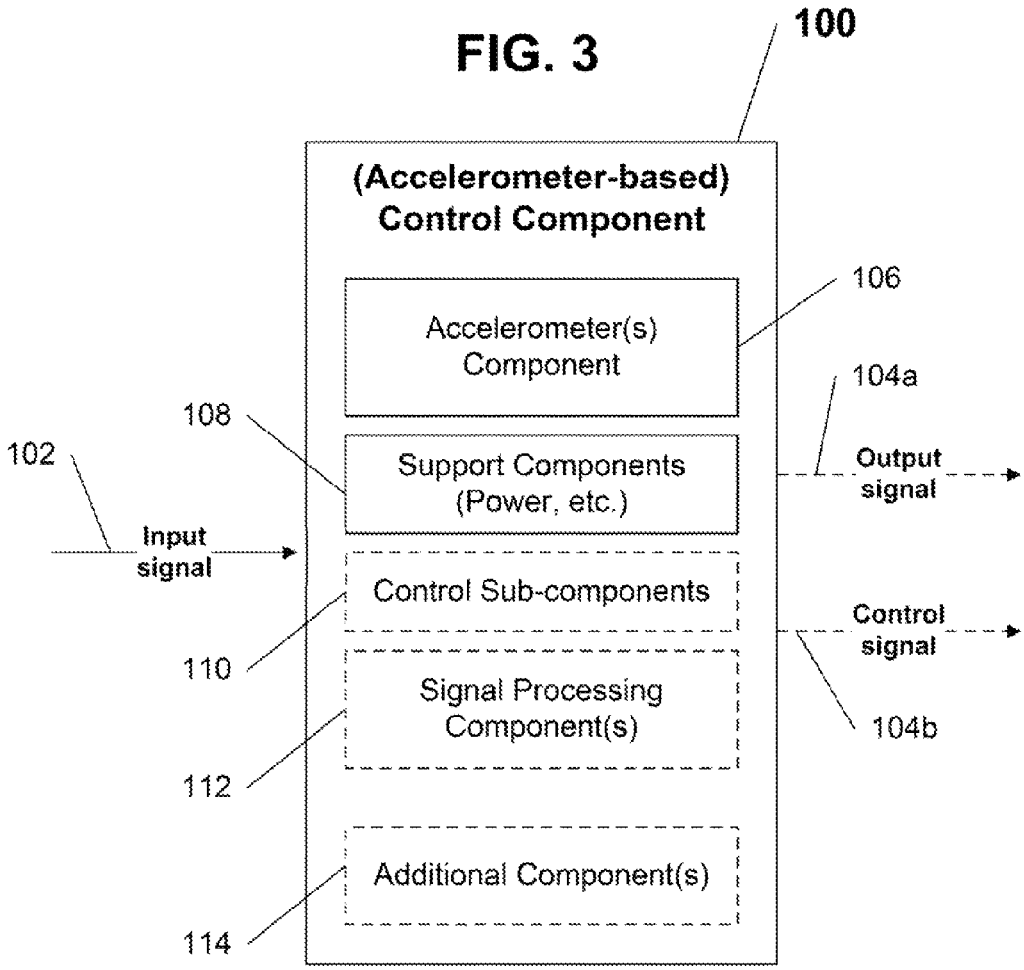
FIG. 3 is a schematic block diagram of an exemplary embodiment of the control component portion of the configurable foot-operable electronic control interface apparatus of FIGS. 1-2.

The above-described configurations and embodiments of the inventive ECI unit 10, are advantageous because they enable utilization in accordance with the present invention of one or more accelerometer sensor components as part of the control component 20, as opposed to previously known use of potentiometers or other electromechanical sensors, and therefore provide the inventive ECI unit 10 with numerous advantageous features (such as extensive flexibility and ease of adaptation to provide various control solutions, and a high degree of configurability, etc.), and heretofore unseen wide range of functionality, as described in greater detail below in connection with FIG. 3, while making it easier to transport and operate, and greatly increasing the reliability thereof (due to lack of moving parts and general shape that facilitates sturdy construction).

Before describing the wide range of possible functionalities of the various embodiments of the inventive ECI unit 10 in connection with FIG. 3, below, it should be noted that the specific size, shape, and position of the housing 16 can be selected and configured as a matter of design choice without departing from the spirit of the invention, and that advantageously, the configuration of front and rear housing portions 16*b*, 16*a* determine the "feel" of the ECI unit 10 to the user. Thus, the front, rear and bottom portions of the housing 16 may each comprise one of many different types of shapes including flat (parallel to the ground) with sharp edges, flat with rounded edges, completely rounded with no sharp edges, flat but angled upward or downward with respect to the ground, or any combination of the above. The options for the shape of the housing 16 front, rear, and bottom portions will facilitate different kinds of pedal platform 12 motion from very smooth, to a more obvious harder edge. The feel of the pedal platform 12 motion to the user will determine how the ECI unit 10 is used or the particular function that the user is enabling. For example the harder edge on one of the front, rear housing portions 16*b*, 16*a* would be useful switching a function on/off, where a smooth rounded edge on the other portion would be useful for sweeping an electrical parameter.

Figure 2:
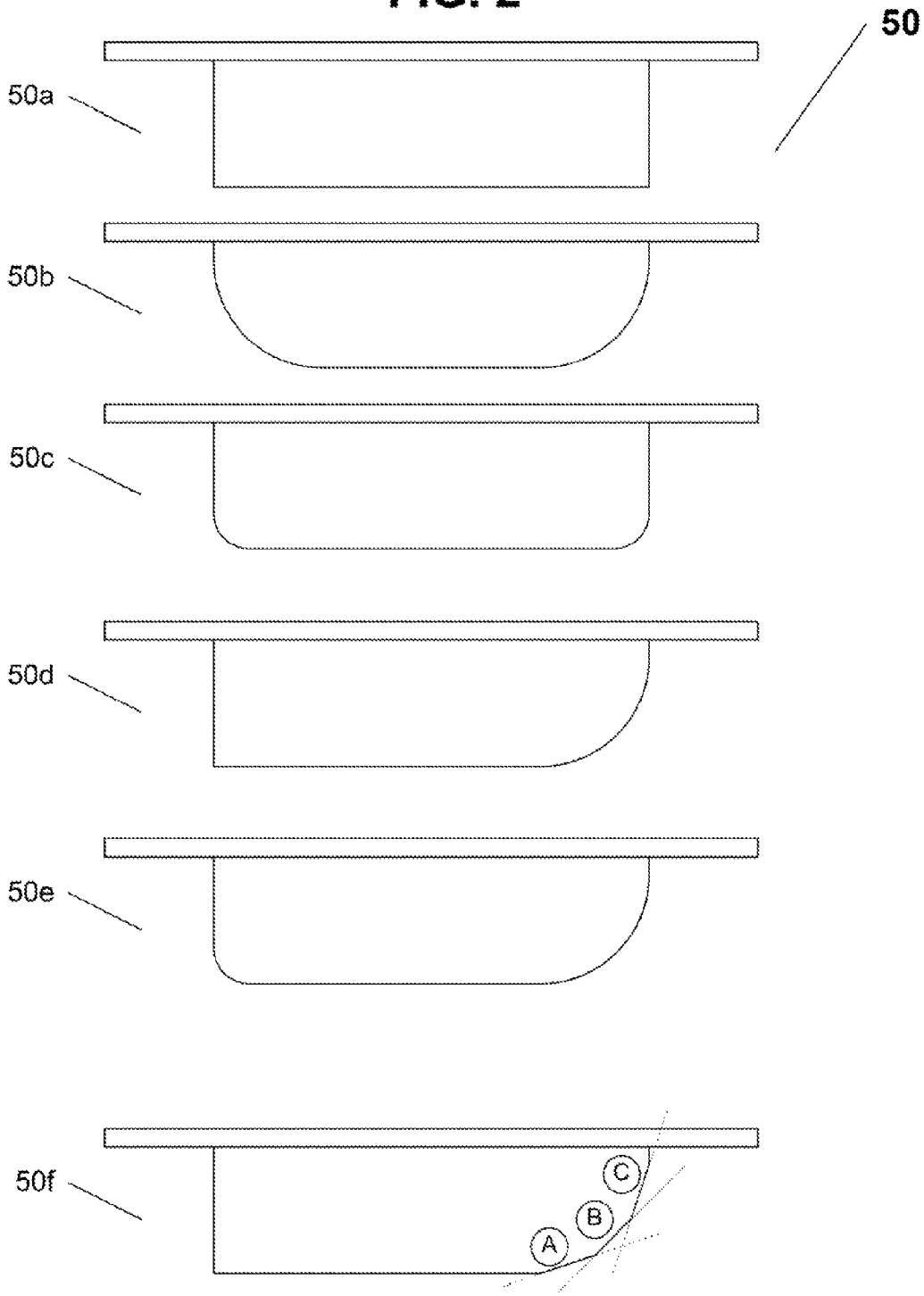
FIG. 2 is a schematic diagram of multiple exemplary alternate embodiments of the configurable foot-operable electronic control interface apparatus of FIG. 1.

Accordingly, in order to facilitate the forward and/or backward titling motion, as well as to provide a desired tilting range (or to limit such range), at least one of the front and/or rear housing portions 16*b*, 16*a* of the housing 16 may be readily configured with a predetermined geometric profile ranging from a rectangular profile to a profile having a curvature of predetermined parameters. By way of example only, various exemplary embodiments of possible profiles of the front and/or rear housing portions 16*b*, 16*a* of the housing 16 are shown in FIG. 2 as ECI unit 50 variants 50*a* to 50*f*. Advantageously, in contrast to most previously known solutions, the predetermined geometric profiles of various embodiments of the inventive ECI unit may be readily configured to cause the ECI unit to automatically return to a neutral (e.g., an "off") position by force of gravity when the user's foot is no longer exerting tilting (or other "shifting") force on the pedal platform 12.

In a basic embodiment of the operation of the inventive ECI unit 10, at least one accelerometer component of the control component 20 is operable to: (1) sense at least one predetermined tilting angle of the pedal platform 12 during the user's control interaction therewith and provide the resulting output to a data processing component of the control component 20, and, (2) in response to one or more parameters output by the at least one accelerometer, generating at least one corresponding control signal as the ECI unit 10 output, the control signal being operable to control, in a predetermined manner, one or more predefined external devices and/or systems (musical instruments, etc.).

Referring now to FIG. 3, an exemplary embodiment of the control component 20 of FIG. 1 is shown as an exemplary control component 100, which may be positioned within the housing 16 of the ECI unit 10 of FIG. 1, and which includes at least one accelerometer sensor component 106, and at least one support component 108 therefor (such as a power supply (e.g., battery, connector for external power source), signal I/O handling circuitry, etc.). The at least one accelerometer sensor component 106 may be an integrated circuit that outputs a voltage according to its acceleration in a particular direction. The at least one accelerometer sensor component 106 may be oriented in the housing 16 so that the voltage is zero with respect to its internal reference when the ECI unit 10 is horizontal, and then becomes negative or positive as the pedal platform 12 is tilted by the user's foot 2 heel-down and toe-down respectively. The magnitude of the voltage is proportional to the product of the sine of the tilt angle and earth's gravity.

In one mode of operation, the control component 100 may be utilized to change an input signal 102 (for example provided by connecting an input line through an appropriate input jack interface provided in a side of the housing 16) into an output signal 104*a* (for example to an output line connected through an appropriate output jack interface provided in a side of the housing 16), in response to changes in relative positions of the at least one accelerometer sensor component 106. The changing of the input signal into the output may be accomplished by an optional signal processing component 112.

The above arrangement may be utilized for a wide variety of applications, such as in musical instrument effect controls, etc. For example, the inventive ECI unit 10 can connected between a guitar (as its input signal) and an amplifier (as destination for its output signal) to enable the guitarist to alter the resonant frequency of a bandpass filter operating on the guitar signal before it is passed to an amplifier and loudspeaker. In this configuration, the accelerometer sensor 106 output voltage is scaled and further processed by the signal processing component 112, to provide the frequency control input of a predefined filter. This further processing preferably may include at least one of: (1) averaging-in-time to remove high frequency noise that the accelerometer sensor 106 may sometimes produce, (2) limiting to constrain the range of resonant frequencies, (e.g., 400 Hz to 2 KHz), and (3) tapering, so that the musician has good control at all parts of the range. By way of example, the above-described signal processing and filtering may be implemented in the signal processing component 112 through analog and/or digital circuitry, as a matter of design choice. In this exemplary embodiment, a front (toe-down) tilt of the pedal platform 12 is preferably used to toggle bypass of the signal processing component 112, such that when it is bypassed, the input signal 102 emerges as the output signal 104*a* without any filtering/processing applied thereto. This bypass arrangement is also superior to any previously known bypass approaches of pedal-based control accessories for musicians.

The control component 100 may also include optional control-subcomponent(s) 112 for enabling the ECI unit 10 to be utilized to produce output control signals 104*b* (e.g., without an input signal), such as to provide a digital control signal corresponding to the ECI unit 10 movements in response to motion of the user's foot 2, for example using USB, MIDI, or any other predetermined digital protocol. This embodiment of the present invention is particularly suited for utilization thereof as a foot-operated control peripheral for various computer (and equivalent—e.g., console game systems, etc,) applications, such as for games, etc.

Optionally, the at least one accelerometer sensor component 106 may be configured to ensure that any undesired motion of the ECI unit 10 would be prevented from affecting the performance thereof. For example, this may be accomplished by application (in digital or analog domain) of one or more of the following techniques: low-pass filtering (e.g., time-averaging), the application of bounds, constraining accelerometer sensor output parameters, ignoring motion of ECI unit 10 until it is determined to be at rest, and any other approach for addressing accelerometer output in an undesirable range.

In various embodiments of the present invention, the control component 100 may be powered by replaceable/rechargeable batteries (preferable) or via A/C connection, and may be configured for activation through a physical on/off switch, or through automatic activation through "jack sensing"—e.g., the control component 100 may be activated when the input signal 102 line is connected via its jack (not shown) into a corresponding plug receptacle provided for the control component 100. In yet another embodiment of the present invention, the ECI unit 10 may be configured to remain in a dormant (e.g., power-off, and/or power-saving) state until such time as the pedal platform 12 is moved (e.g., tilted, etc.) by the user. Optionally, the ECI unit 10 may be configured to be operable to enter an active functioning state in response to one or more predefined movement "triggers" (e.g., a tilt of the pedal platform 12 in a particular predefined direction).

In further inventive embodiments of the control component 100, it may be configured in accordance with at least one of the following techniques:

(a) electronically (i.e., it can be supplied with a port capable of communicating with a computer or equivalent so that the control/configuration/setting selection can be software based), and/or (b) it can be configured by physical controls (e.g., switches, knobs, dials, etc.) provided (not shown) on one of the sides of the housing 16.

Advantageously, the apparatus and method of the present invention may include the following exemplary features and functions without departing from the spirit of the invention:

(1) Utilization/Sensing of Multiple Dimensions of Motion: A typical pedal-based control uses one axis of rotation (y axis) to provide its control output. As discussed above, the ECI unit 10 can be configured to also sense "roll" rotation along the x-axis (or center-line of rotation). In the roll rotation the user would rotate their foot around the x-axis center line of the ECI unit 10. Furthermore, with the addition of a "Hall effect" or magneto-resistive sensor (e.g., as additional component(s) 114 for the control unit 100), the ECI unit 10 can be configured to sense rotation around the z-axis. The z-axis rotation enables the user to move the ECI unit 10 laterally left and right for a third dimension of rotation (thus providing an additional range of control/signal processing capabilities thereto).

(2) Wireless Transmission of Control Data: Optionally, data from the control component 100 can be wirelessly transmitted to a predetermined receiver unit, allowing a user to use the ECI unit 100 remotely (and wirelessly).

(3) Strapping ECI unit 10 to Shoes: Related to the wireless data transmission feature, above, in an alternate embodiment thereof, the ECI unit 10 can be strapped to user's shoes or other body parts and even to another device (such as the user's musical instrument). In one example of strapping the ECI unit 10 to shoes, the user would then stomp around with the ECI unit 10 on their shoes controlling ECI unit 10 with their footsteps. Installing the ECI unit 10 to an instrument, such as guitar, would allow the user to modulate an electrical parameter by rotating the guitar.

In alternate embodiments of the invention, plural ECI units 10 may be readily used to provide a greater range of control capabilities to a single external system, or to provide simultaneous control capabilities to plural external systems. Advantageously, the apparatus and method of the present invention can be used to provide a configurable, flexible and reliable foot-operable control interface to virtually any electronic and/or electromechanical system.

Thus, while there have been shown and described and pointed out fundamental novel features of the invention as applied to preferred embodiments thereof, it will be understood that various omissions and substitutions and changes in the form and details of the devices and methods illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention.

We claim:

1. A control apparatus for producing at least one predetermined output effect in response to at least one predetermined interaction(s) therewith by a user, comprising:

a platform sized and configured to receive a lower surface of the user's foot;

a housing, of a smaller size than said platform and attached thereunder, said housing being positioned and configured to enable the user to perform at least one interaction with said platform to impart at least one corresponding movement to said housing; and a single control component, disposed within said housing, and being operable to: (a) sense said at least one corresponding movement, and (b) generate the at least one predetermined output effect in response thereto.

2. The control apparatus of claim 1, wherein said at least one corresponding movement comprises a predetermined direction and angular range of tilting of both said platform and said housing with respect to a reference surface, and wherein said single control component comprises an accelerometer sensor, operable to sense said predetermined direction and a tilt angle of said platform and housing, and to produce a corresponding output signal.

3. A control apparatus for producing at least one predetermined output effect in response to at least one predetermined interaction(s) therewith by a user, comprising:

a housing, said housing being configured to be affixable to an object movable by the user, so as to enable the user to perform at least one interaction with said object to impart at least one corresponding movement to said housing; and a single control component, disposed within said housing, and being operable to: (a) sense said at least one corresponding movement, and (b) generate the at least one predetermined output effect in response thereto.

4. The control apparatus according to claim 3, wherein the object is a musical instrument and the at least one predetermined output effect is generated in response to motion imparted to the musical instrument by the user.

* * * * *